US005333575A

United States Patent [19]

Olmr

[11] Patent Number: 5,333,575

[45] Date of Patent: Aug. 2, 1994

[54] INTERNAL COMBUSTION ENGINE USING LUBRICATING OIL FOR EFFECTIVE AND UNIFORM COOLING

[75] Inventor: Jaroslav J. Olmr, Sheboygan, Wis.

[73] Assignee: Kohler Co., Kohler, Wis.

[21] Appl. No.: 78,994

[22] Filed: Jun. 18, 1993

[51] Int. Cl.[5] ..... F01P 3/00

[52] U.S. Cl. ..... 123/41.42; 123/41.52; 123/41.57; 184/104.3

[58] Field of Search ..... 123/41.42, 41.55, 41.57, 123/196 AB, 41.33, 195 C, 41.52; 184/104.3, 106

[56] References Cited

U.S. PATENT DOCUMENTS

| | | | |
|---|---|---|---|
| 1,420,684 | 6/1922 | Bradshaw . | |
| 2,691,972 | 10/1954 | Stump et al. | 123/196 AB |
| 2,959,163 | 11/1960 | Hodkin | 123/41.42 |
| 3,127,879 | 4/1964 | Giacosa et al. | 123/41.42 |
| 3,493,081 | 2/1970 | Tado | 184/104 |
| 4,562,799 | 7/1986 | Woods et al. | 123/193 C |
| 4,607,601 | 8/1986 | Kohler | 123/90.31 |
| 4,702,204 | 10/1987 | Anno et al. | 123/196 AB |
| 4,771,745 | 9/1988 | Nakamura et al. | 123/196 R |
| 4,813,408 | 3/1989 | Katsumoto et al. | 123/196 AB |
| 4,928,651 | 5/1990 | Kronich | 123/196 AB |

FOREIGN PATENT DOCUMENTS

| | | |
|---|---|---|
| 2649562 | 10/1976 | Fed. Rep. of Germany . |
| 2000223 | 1/1979 | United Kingdom . |

*Primary Examiner*—Noah P. Kamen
*Attorney, Agent, or Firm*—Quarles & Brady

[57] ABSTRACT

An internal combustion engine which employs lubricating oil as part of the cooling system. A sleeve forms the cylinder wall and is completely surrounded by a jacket space formed by a wall exposed to the atmosphere, including air circulated by the engine's fan. An oil pump maintains the jacket space substantially full of oil which transfers heat from the sleeve to the outer wall. On its return, the oil passes through an intermeshed heat exchange which has a set of horizontal shelves formed on the inside of the crankcase wall and an opposing and intermeshed set of horizontal shelves located inside the crankcase. A series of fins are formed on the outside of engine walls opposite the oil jacket and the intermeshed heat exchanger.

6 Claims, 2 Drawing Sheets

INTERNAL COMBUSTION ENGINE USING LUBRICATING OIL FOR EFFECTIVE AND UNIFORM COOLING

BACKGROUND OF THE INVENTION

The invention relates generally to systems for cooling internal combustion engines and more particularly to such systems which employs engine lubricating oil as a coolant.

Two important objectives of an engine cooling system are to hold engine lubricating oil to a temperature at which it remains effective and to minimize temperature gradients in the cylinders. If lubricating oil temperature is excessively high, it loses its effectiveness and excessive engine wear results. Temperature gradients in the cylinders distort the shape of the cylinder walls. This results in accelerated wear, increased oil consumption and greater discharge of undesirable engine emissions. Avoiding these problems is particularly difficult in an air-cooled engine.

It is known to employ engine lubricating oil as a coolant to supplement water and air cooling systems. See, for example, U.S. Pat. Nos. 2,691,972, 4,702,204 and 4,813,408 pertaining to water-cooled engines. The engine disclosed in U.S. Pat. No. 4,928,651 air-cools lubricating oil in a pressure lubrication system.

There is a need for a more effective, simpler and lower cost system for employing lubricating oil as part of an engine cooling system.

SUMMARY OF THE INVENTION

The objects of the invention include reducing oil consumption, lessening emissions resulting from the burning of lubricating oil and extending the life of internal combustion engines by reducing wear.

To attain these objectives, the invention provides a structure for substantially enveloping the outer wall of a cylinder with a layer of flowing oil which is directly adjacent to a heat-exchange-enhanced outer engine wall and by providing an intermeshed step return path for the oil which enhances the heat exchange capacity of another portion of an outer engine wall.

More specifically, the claimed internal combustion engine has a cylinder structure which includes a sleeve having an inner surface defining a cylinder cavity. A piston slides within the cylinder cavity. There is a jacket wall having an inner surface defining a jacket space substantially surrounding the cylinder sleeve. The outer surface of the jacket wall is exposed to the atmosphere. The engine has a crankcase whose walls define a reservoir for containing the oil. There is a pump capable of moving the oil from the reservoir into the jacket space, maintaining the jacket space substantially full of oil during the operation of the engine, and expelling the oil out of the jacket space.

In addition, there may be a heat conducting fin formed on the outer surface of the jacket wall.

In a further aspect, the invention comprises an internal combustion engine which has a cylinder structure which includes a cylinder wall having an inner surface defining a cylinder cavity. A piston slides within the cylinder cavity. A jacket encloses the outer surface of the cylinder wall. It has an inlet port and an outlet port. The engine crankcase has walls defining a reservoir for containing the oil. There is a pump capable of moving the oil from the reservoir into the inlet port, maintaining the jacket substantially full of the oil during the operation of the engine and expelling the oil from the outlet port. Located in a path for returning the oil to the reservoir is an intermeshed heat exchange structure. It includes at least two substantially horizontally oriented and vertically spaced apart members formed on and extending inwardly from at least one of the crankcase walls and at least two substantially horizontal and vertically spaced apart outwardly extending members located within the crankcase and which overlap and intermesh with the inwardly extending members to form a maze-like passage through which oil flows. As a result, the returning oil alternately flows inwardly over an inwardly extending member and onto and outwardly over the outwardly extending member below it, which directs it back onto the next lower inwardly extending member, and so forth.

In a further aspect, the invention may include at least two substantially horizontally oriented and vertically spaced apart members formed on and protruding outwardly from a portion of the crankcase wall which supports the intermeshed heat exchange structure.

The invention has the advantage of minimizing temperature gradients in the cylinder wall by ensuring that the cylinder wall is substantially enveloped by a layer of flowing lubricating oil. A further advantage is enhanced cooling which results from causing the lubricating oil to flow along large expanses of the external engine wall, whose heat exchange capabilities have been enhanced by fin arrangements.

These and other objects and advantages will be apparent from the following description of a preferred embodiment. This embodiment does not represent the full scope of the invention, but rather the invention may be employed in other embodiments.

DESCRIPTION OF THE PREFERRED EMBODIMENTS

Figure 1:
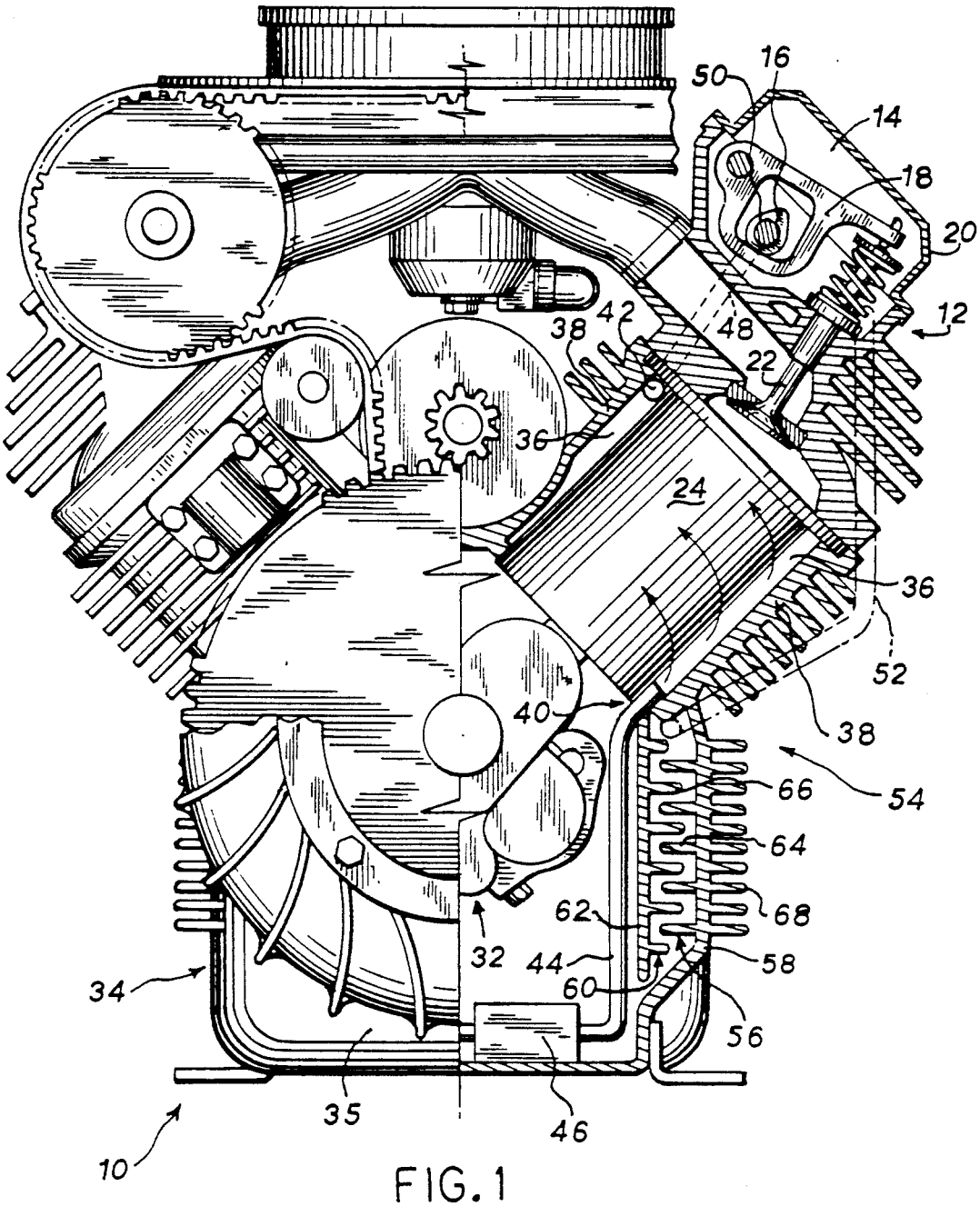
FIG. 1 is a front view of an engine which embodies the invention, the right half of FIG. 1 being sectional and partially schematic.
Figure 2:
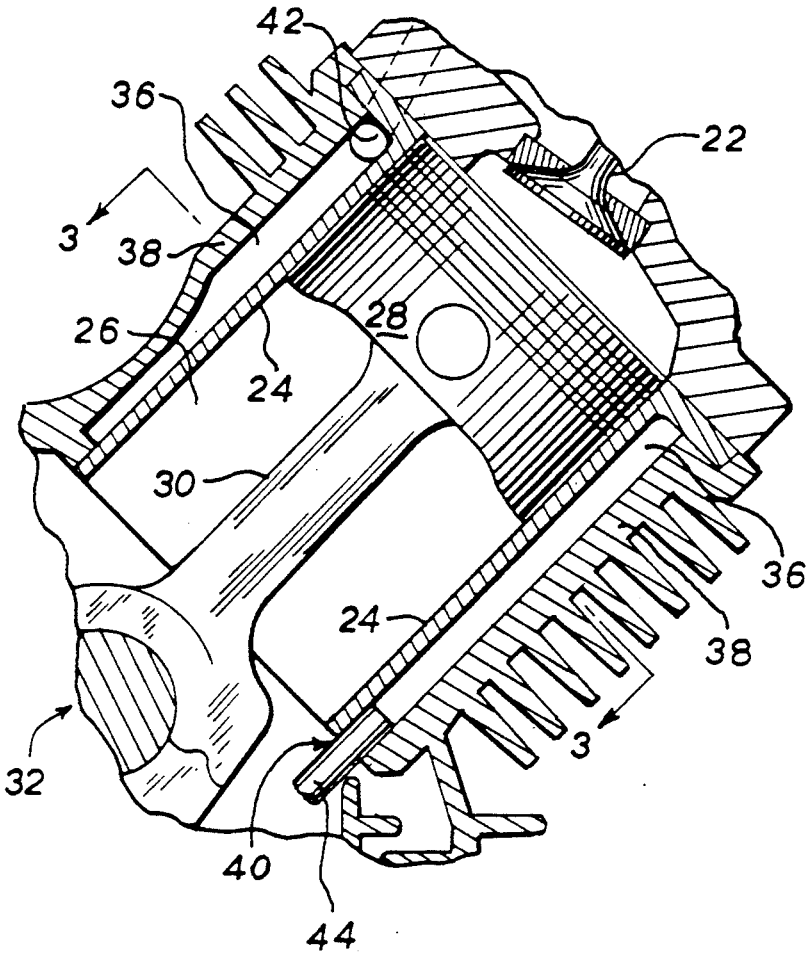
FIG. 2 is an enlarged, sectional view of the cylinder structure of the engine of FIG. 1.

FIG. 1 shows a V-2 air-cooled engine 10 such as one developing 10–30 HP for use in a utility tractor. The cylinder head 12 encloses a valve actuating mechanism 14 which includes a cam 16 and rocker arm 18 housed in the rocker case 20; they operate a valve 22 which interfaces with the cylinder structure. The cylinder structure includes a cylinder sleeve 24 which defines a cylinder cavity 26 (FIG. 2) within which slides a piston 28. A connecting rod 30 joins the piston to the crankshaft assembly 32, which is located in the crankcase 34 which serves as a reservoir 35 for lubricating oil. (As used herein, "oil" means lubricating liquids of all types, including those synthetically made.) Other components of the engine will be apparent to those of ordinary skill in the engine art.

The cylinder sleeve 34 is surrounded by a space ("jacket space") 36 formed by a jacket wall 38 which also serves as part of the outer wall of the engine and is therefore exposed to the atmosphere, including air circulated by the engine's fan (not shown). The jacket space 36 is closed at the bottom except for an inlet port 40 and at the top except for an outlet port 42. The inlet port 40 communicates via a tube or other passageway 44 with an oil pump located in the reservoir 35. The outlet port 42 is flowably connected to a tube or passageway 48 (shown in phantom in FIG. 1) leading to the valve actuating mechanism 14, in particular to the bearings of the cam shaft 50.

In operation, the pump 46 moves oil from the reservoir 35 into the jacket space 36, maintains the jacket space 36 substantially full of flowing oil and forces oil out of the outlet port 42 and into the valve actuating mechanism 14. After lubricating that mechanism 14, the oil flows into a return tube or passageway 52 (shogun in phantom in FIG. 1) leading to the intermeshed heat exchanger 54.

The intermeshed heat exchanger 54 consists of two sets of vertically spaced horizontal shelf-like members. The outer set 56 (which has inwardly facing shelves) is formed on and extends inwardly from an exterior engine wall 58 at the crankcase portion of the engine. The inner set 60 (which has outwardly facing shelves) is formed on and extends outwardly from a support 62 located within the crankcase 34, which may be mounted in any of several possible ways, such as between the longitudinal ends of the crankcase or to the floor of the crankcase. The shelves on the two sets overlap and are intermeshed.

Oil flows from the return tube 52 partly onto the highest inwardly facing shelf 64 and partly onto the highest outwardly facing shelf 66. Oil flowing on an outwardly facing shelf directs the oil onto the inwardly facing shelf below it. Oil flowing on an inwardly facing shelf drops onto the outwardly facing shelf below it, which directs the oil back to the inwardly facing shelf below it. As a result, the returning oil flows over, and thereby connectively transfers heat to, each of the inwardly facing shelves. Since the inwardly facing shelves are formed on the outer wall 58 of the crankcase, they conduct heat from the oil to the outer surface of the crankcase wall, where is can be convected by the air circulated by the engine fan.

Convection transfer of heat from the outer engine wall 38, 58 to the fan-circulated air is enhanced by fins 68 arranged on the outer surface of the wall 38, 58 in ladder-like fashion. These fin structures are located opposite the oil jacket 36 and opposite the intermeshed heat exchanger 54.

The foregoing features achieve the objects of the invention in the following manner.

Figure 3:
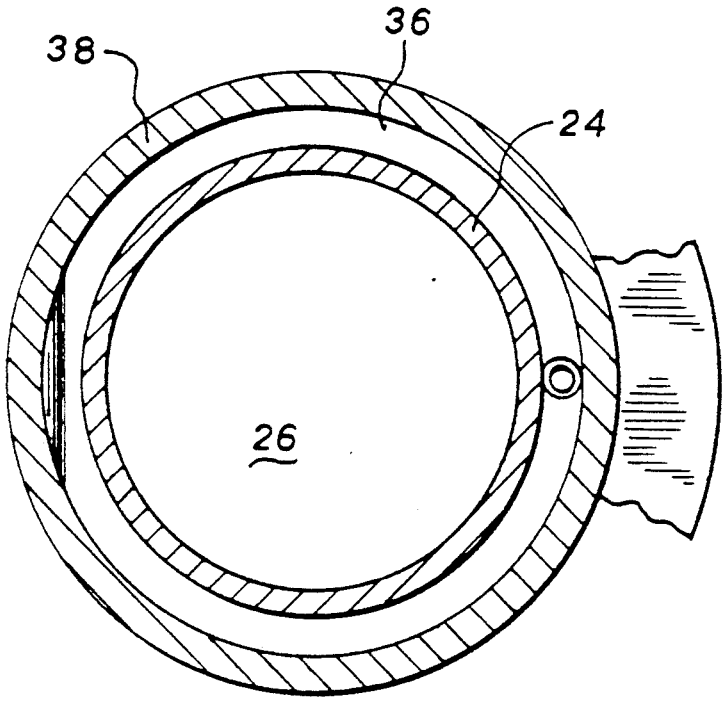
FIG. 3 is a sectional view taken along line 3—3 of FIG. 2.

As shown in greater detail in FIG. 3, the oil jacket space 36 completely surrounds the cylinder sleeve 24 and thereby envelopes the entire cylinder 26 with a uniform layer of flowing oil. This layer acts as a buffer between the cylinder sleeve 24 and the environment, including the fan-circulated air. Therefore, the temperature of the cylinder sleeve 24 is substantially independent of spatial and temporal gradients in the environmental temperature. This reduces distortion of the cylinder sleeve 24 and therefore reduces oil consumption and engine emissions and enhances engine longevity.

The full envelopment of the cylinder sleeve 24 by a uniform layer of circulating oil also enhances engine cooling because there is a large area from which heat is convected from the sleeve to the oil. Further enhancing engine cooling is the fact that the oil is in contact with large areas of the external walls of the engine. These areas include the outer wall 38 of the oil jacket of each cylinder and the crankcase wall 58 at the site of the intermeshed heat exchanger 54. The intermeshed heat exchanger 54 has the effect of substantially enlarging the surface of the engine wall over which oil flows and thereby greatly enhances convection of heat from the oil to the engine wall, where it can be connectively dissipated. This convection is enhanced by the ladder-like fin 68 arrangements on the engine walls 38, 58 opposite the oil jacket and the intermeshed heat exchanger.

I claim:

1. An internal combustion engine which employs oil for lubrication, comprising:

(a) a cylinder structure including a sleeve having an inner surface defining a cylinder cavity for receiving a piston sliding within it and an outer surface;

(b) a jacket wall having an inner surface defining a jacket space substantially surrounding the cylinder sleeve and an outer surface which is exposed to the atmosphere and which is enclosed except for an inlet port and an outlet port;

(c) a crankcase having walls defining a reservoir for containing the oil;

(d) a pump capable of moving the oil from the reservoir into the jacket space through the inlet port, maintaining the jacket space substantially full of oil during the operation of the engine, and expelling the oil out of the jacket space through the outlet port;

(e) a path for returning the oil to the reservoir; and (f) an intermeshed heat exchange structure located in the return path, including at least two substantially horizontally oriented and vertically spaced apart members formed on and extending inwardly from at least one of the crankcase walls and at least two substantially horizontal and vertically spaced apart outwardly extending members located within the crankcase and which overlap and intermesh with the inwardly extending members to form a maze-like passage through which the oil flows, whereby the returning oil alternately flows inwardly over an inwardly extending member and onto and outwardly over the outwardly extending member below it, which directs it back onto the next lower inwardly extending member, and so forth.

2. An internal combustion engine as in claim 1, further comprising a heat conducting fin formed on the outer surface of the jacket wall.

3. An internal combustion engine which employs oil for lubrication, comprising:

(a) a cylinder structure including a cylinder wall having an inner surface defining a cylinder cavity disposed to accommodate a piston sliding within it and an outer surface;

(b) a jacket enclosing the outer surface of the cylinder wall except for an inlet port and an outlet port;

(c) a crankcase having walls defining a reservoir for containing the oil;

(d) a pump capable of moving the oil from the reservoir into the inlet port, maintaining the jacket substantially full of oil during the operation of the engine and expelling the oil from the outlet port;

(e) a path for returning the oil to the reservoir; and (f) an intermeshed heat exchange structure located in the return path, including at least two substantially horizontally oriented and vertically spaced apart members formed on and extending inwardly from at least one of the crankcase walls and at least two substantially horizontal and vertically spaced apart outwardly extending members located within the crankcase and which overlap and intermesh with the inwardly extending members to form a maze-like passage through which the oil flows, whereby the returning oil alternately flows inwardly over an inwardly extending member and onto and outwardly over the outwardly extending member below it, which directs the oil back onto the next lower inwardly extending member, and so forth.

4. An internal combustion engine as in claim 3, further comprising at least two substantially horizontally oriented and vertically spaced apart members formed on and protruding outwardly from the portion of the crankcase wall which supports the intermeshed heat exchange structure.

5. In an internal combustion engine which employs oil to lubricate moving parts and which has a crankcase having walls defining a reservoir for containing the oil, a pump capable of moving the oil from the reservoir to the moving parts and a return path for returning the oil to the reservoir, the engine-cooling improvement comprising an intermeshed heat exchange structure located in the return path, including at least two substantially horizontally oriented and vertically spaced apart members formed on and extending inwardly from at least one of the crankcase walls and at least two substantially horizontal and vertically spaced apart outwardly extending members located within the crankcase and which overlap and intermesh with the inwardly extending members to form a maze-like passage through which the oil flows, whereby the returning oil alternately flows inwardly over an inwardly extending member and onto and outwardly over the outwardly extending member below it, which directs it back onto the next lower inwardly extending member, and so forth.

6. An internal combustion engine as in claim 5, further comprising at least two substantially horizontally oriented and vertically spaced apart members formed on and protruding outwardly from the portion of the crankcase wall which supports the intermeshed heat exchange structure.

* * * * *

UNITED STATES PATENT AND TRADEMARK OFFICE

CERTIFICATE OF CORRECTION

PATENT NO. : 5,333,575

DATED : August 2, 1994

INVENTOR(S) : Jaroslav J. Olmr

It is certified that error appears in the above-indentified patent and that said Letters Patent is hereby corrected as shown below:

In col. 3, line 13, "Shogun" is replaced with -- shown--.

In col. 3, line 36, "Connectively" is replaced with --Convectively--.

In col. 4, line 5, "Connectively" is replaced with --Convectively--.

Signed and Sealed this

Eighteenth Day of October, 1994

Bruce Lehman

*Attest:*

BRUCE LEHMAN

*Attesting Officer*

*Commissioner of Patents and Trademarks*